US007595444B2

(12) United States Patent
Stewart

(10) Patent No.: US 7,595,444 B2
(45) Date of Patent: Sep. 29, 2009

(54) ELECTROMAGNETIC TRANSDUCER FOR INSTRUMENT PICKUPS

(76) Inventor: Bret Thomas Stewart, 1153 Appleland Dr., Wenatchee, WA (US) 98801

( * ) Notice: Subject to any disclaimer, the term of this patent is extended or adjusted under 35 U.S.C. 154(b) by 0 days.

(21) Appl. No.: 11/828,154

(22) Filed: Jul. 25, 2007

(65) Prior Publication Data

US 2008/0245218 A1 Oct. 9, 2008

Related U.S. Application Data

(63) Continuation-in-part of application No. 11/697,718, filed on Apr. 7, 2007, now abandoned.

(51) Int. Cl.
*G10H 3/18* (2006.01)

(52) U.S. Cl. ..... 84/728; 84/726; 84/725

(58) Field of Classification Search ..... 84/723, 84/725–729

See application file for complete search history.

(56) References Cited

U.S. PATENT DOCUMENTS

| | | | | | |
|---|---|---|---|---|---|
| 1,915,858 | A | * | 6/1933 | Miessner | 84/723 |
| 1,933,296 | A | * | 10/1933 | Jacobs | 84/735 |
| 1,977,939 | A | * | 10/1934 | Fichandler | 363/110 |
| 2,089,171 | A | * | 8/1937 | Beauchamp | 84/726 |
| 2,130,174 | A | * | 9/1938 | Beauchamp | 84/727 |
| 2,152,783 | A | * | 4/1939 | Beauchamp | 84/313 |
| 2,225,299 | A | * | 12/1940 | Demuth | 84/726 |
| 2,310,199 | A | * | 2/1943 | Beauchamp | 84/723 |
| 2,968,204 | A | | 1/1961 | Fender | |
| 3,571,483 | A | * | 3/1971 | Davidson | 84/726 |
| 3,675,529 | A | * | 7/1972 | Van Der Woerd | 84/455 |
| 4,137,811 | A | * | 2/1979 | Kakehashi | 84/726 |
| 4,181,058 | A | * | 1/1980 | Suenaga | 84/726 |
| 4,182,213 | A | * | 1/1980 | Iodice | 84/728 |
| 4,348,930 | A | * | 9/1982 | Chobanian et al. | 84/726 |
| 4,378,722 | A | * | 4/1983 | Isakson | 84/726 |
| 4,408,513 | A | * | 10/1983 | Clevinger | 84/726 |
| 4,499,809 | A | * | 2/1985 | Clevinger | 84/726 |

(Continued)

OTHER PUBLICATIONS

Pfliegel P., Telecommunications, http://www.hit.bme.hu/~pfliegel/telecomm/04acoust. htm.

*Primary Examiner*—David S. Warren
(74) *Attorney, Agent, or Firm*—Ruttler & Long PLLC; James J. Ruttler

(57) ABSTRACT

This invention relates generally to electromagnetic transducers, and more specifically, to devices that convert the mechanical vibrations of a magnetically permeable object, such as a ferromagnetic instrument string, into an electrical signal using electromagnetism. In one embodiment, the invention includes a core, the core being magnetically susceptible, the core including opposing ends that are in close proximity to each other to define a gap, the gap configurable to receive a portion of at least one string, the at least one string being magnetically susceptible; a magnet, the magnet configurable to being disposed proximate to the at least one string and configurable to transfer magnetic flux to the at least one string, the magnetic flux from the at least one string being transferable to the core through the opposing ends; and a coil, the coil being disposed about the core, the coil being configurable to produce current in response to the magnetic flux from the core, wherein mechanical vibration of the at least one string produces a vibration of the magnetic flux in the core that induces current in the coil.

18 Claims, 6 Drawing Sheets

U.S. PATENT DOCUMENTS

| | | | | | |
|---|---|---|---|---|---|
| 4,907,483 | A | * | 3/1990 | Rose et al. | 84/726 |
| 5,012,716 | A | * | 5/1991 | Pagelli | 84/727 |
| 5,123,324 | A | * | 6/1992 | Rose et al. | 84/726 |
| 5,206,449 | A | * | 4/1993 | McClish | 84/723 |
| 5,233,123 | A | * | 8/1993 | Rose et al. | 84/726 |
| 5,354,949 | A | | 10/1994 | Zwaan | |
| 5,399,802 | A | * | 3/1995 | Blucher | 84/726 |
| 5,430,246 | A | * | 7/1995 | Lace et al. | 84/726 |
| 5,523,526 | A | * | 6/1996 | Shattil | 84/728 |
| 5,637,818 | A | | 6/1997 | Fishman | |
| 5,834,999 | A | | 11/1998 | Kinman | |
| 5,894,101 | A | * | 4/1999 | Damm | 84/728 |
| 5,949,014 | A | * | 9/1999 | Rashak et al. | 84/725 |
| 6,211,671 | B1 | * | 4/2001 | Shattil | 324/225 |
| 6,372,976 | B2 | * | 4/2002 | Damm | 84/723 |
| 6,392,137 | B1 | * | 5/2002 | Isvan | 84/726 |
| 6,563,933 | B1 | | 5/2003 | Niederdraenk | |
| 7,087,828 | B2 | * | 8/2006 | Krieger | 84/454 |
| 7,166,794 | B2 | | 1/2007 | Juszkiewicz et al. | |
| 7,189,916 | B2 | * | 3/2007 | Kinman | 84/726 |
| 2002/0083819 | A1 | * | 7/2002 | Kinman | 84/726 |
| 2003/0051596 | A1 | * | 3/2003 | Gustafsson | 84/723 |
| 2005/0028669 | A1 | * | 2/2005 | Kavanaugh | 84/726 |

* cited by examiner

ELECTROMAGNETIC TRANSDUCER FOR INSTRUMENT PICKUPS

PRIORITY CLAIM

This application is a continuation-in-part of prior application Ser. No. 11/697,718 filed Apr. 7, 2007. The foregoing application is hereby incorporated by reference in its entirety as if fully set forth herein.

FIELD OF THE INVENTION

This invention relates generally to electromagnetic transducers, and more specifically, to devices that convert the mechanical vibrations of a magnetically permeable object, such as a ferromagnetic instrument string, into an electrical signal using electromagnetism.

BACKGROUND

Electromagnetic transducers have been used in musical instruments for many years. When used on instruments, a transducer is commonly referred to as a pickup. Fender (U.S. Pat. No. 2,968,204) discloses a common type of pickup that is prevalent on many modern electric guitars. It consists of a several cylindrically shaped magnetic elements, commonly known as pole pieces, each having an electrically conductive coil disposed thereon. The pole pieces are linearly aligned and extend perpendicularly away from the body of a guitar. Each string of the guitar is configurable to extend through the center of adjacent pole pieces. The Fender pickup is plagued with several problems. Most notably, the linear design of the Fender pickup causes it to reproduce stray magnetic fields, thereby introducing unwanted noise into resulting signals. Isakson (U.S. Pat. No. 4,378,722) addresses this problem by introducing a series of ring-shaped pickups for receiving instrument strings therein, thereby minimizing the reproduction of stray magnetic fields. While the Isakson pickups reduce noise, they simultaneously suffer because each of the ring-shaped pickups is only weakly affected by magnetic flux. Davidson (U.S. Pat. No. 3,571,483) addresses the limitations of Isakson and Fender by using a linear pole piece that is enclosed by a yoke of opposite polarity that acts as a magnetic shield. Although Davidson offers some improvements, it suffers in that its design is overly complex, expensive, and unable to interface with standard guitars.

The Fender pickup also suffers because it is unable to separate signals from each individual magnetic element and because it reproduces signals from every plane of string vibration. These limitations result in lower quality signals and introduce difficulties in reproducing an instrument's entire range of frequencies. Isvan (U.S. Pat. No. 6,392,137), Juszkiewicz (U.S. Pat. No. 7,166,794), and Isakson teach pickup designs that reproduce signals from each magnetic element and from a single plane of string vibration. However, they each rely on the ring-shaped pickups described supra for Isakson. And, although Davidson teaches a pickup design that reproduces signals from each magnetic element, the signals are insensitive to the plane of string vibration.

Accordingly, none of the available pickup designs have been able to simultaneously provide low noise, high magnetic flux sensitivity, signal independence, and sensitivity to a single plane of string vibration. What is needed then is a novel electromagnetic transducer for instrument pickups.

SUMMARY

This invention relates generally to electromagnetic transducers, and more specifically, to devices that convert the mechanical vibrations of a magnetically permeable object, such as a ferromagnetic instrument string, into an electrical signal using electromagnetism. In one embodiment, the invention includes a core, the core being magnetically susceptible, the including opposing ends that are in close proximity to each other to define a gap, the gap configurable to receive a portion of at least one string, the at least one string being magnetically susceptible; a magnet, the magnet configurable to being disposed proximate to the at least one string and configurable to transfer magnetic flux to the at least one string, the magnetic flux from the at least one string being transferable to the core through the opposing ends; and a coil, the coil being disposed about the core, the coil being configurable to produce current in response to the magnetic flux from the core, wherein mechanical vibration of the at least one string produces a vibration of the magnetic flux in the core that induces current in the coil.

Advantages of the invention include low noise, high magnetic flux sensitivity, signal independence, sensitivity to a single plane of string vibration, and scalability. Additional objects and advantages will become apparent from a consideration of the drawings and ensuing descriptions.

BRIEF DESCRIPTION OF THE DRAWINGS

Embodiments of the present invention are described in detail below with reference to the following drawings.

DETAILED DESCRIPTION

This invention relates generally to electromagnetic transducers, and more specifically, to devices that convert the mechanical vibrations of a magnetically permeable object, such as a ferromagnetic instrument string, into an electrical signal using electromagnetism. Specific details of certain embodiments of the invention are set forth in the following description and in FIGS. 1-7 to provide a thorough understanding of such embodiments. The present invention may have additional embodiments, may be practiced without one or more of the details described for any particular described embodiment, or may have any detail described for one particular embodiment practiced with any other detail described for another embodiment.

Figure 1:
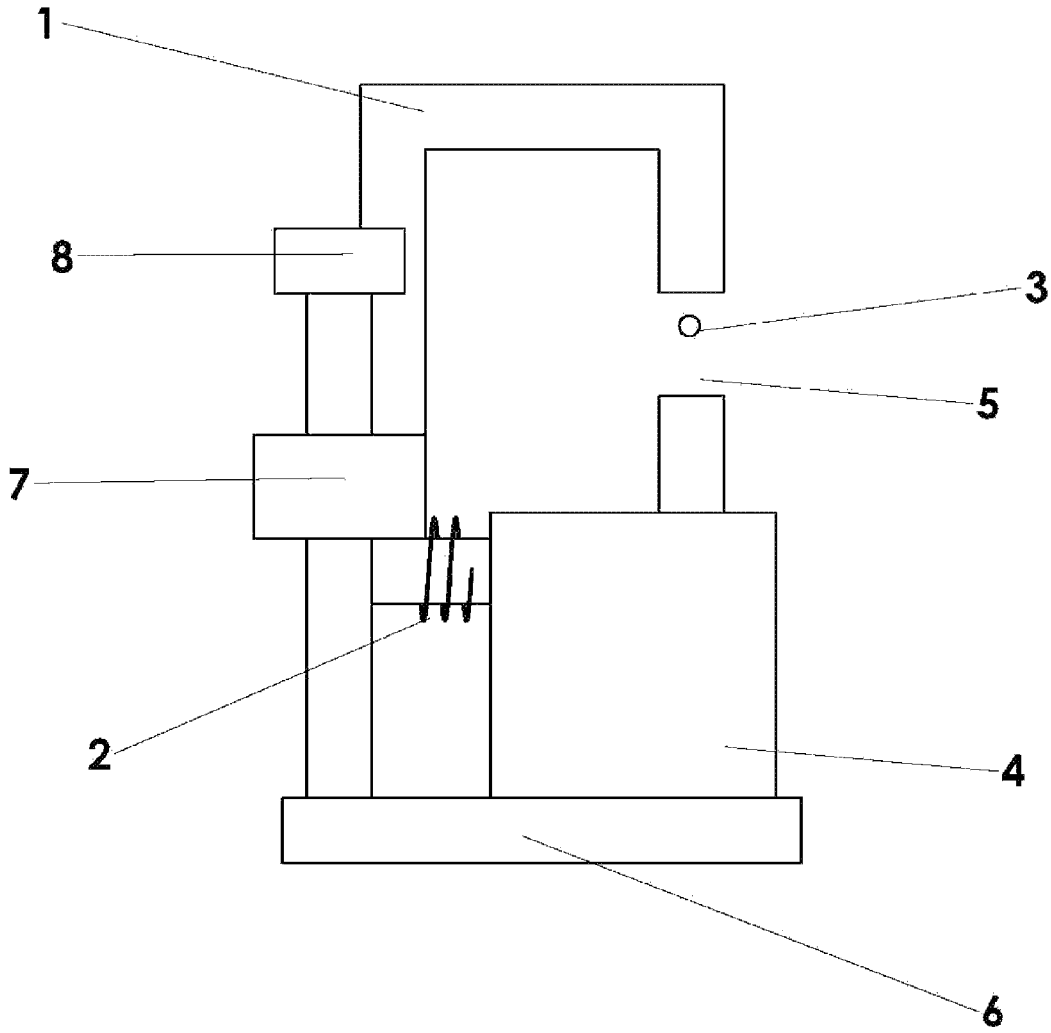
FIG. 1 is a front elevational view of a pickup, in accordance with an embodiment of the invention.
Figure 2:
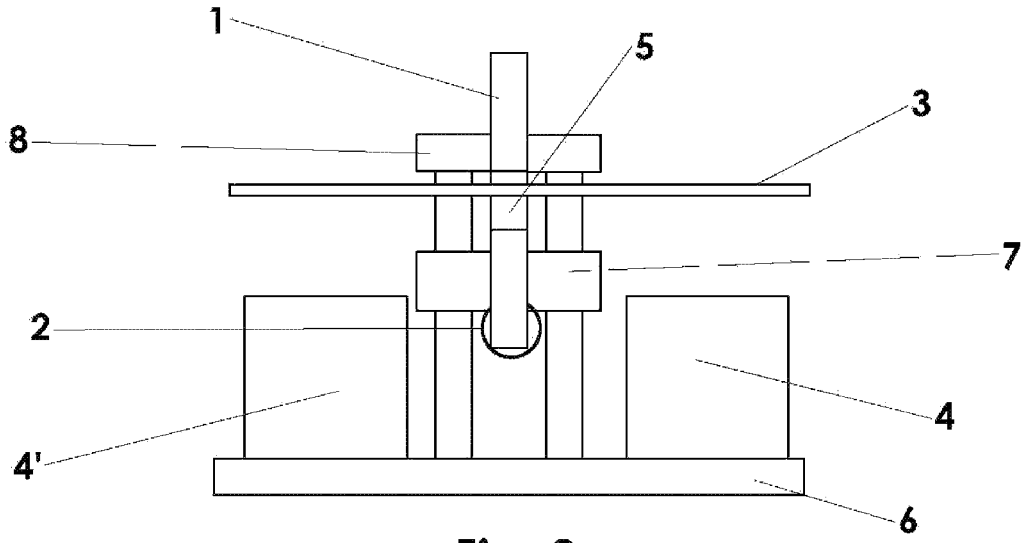
FIG. 2 is a side elevational view of a pickup, in accordance with an embodiment of the invention.
Figure 3:
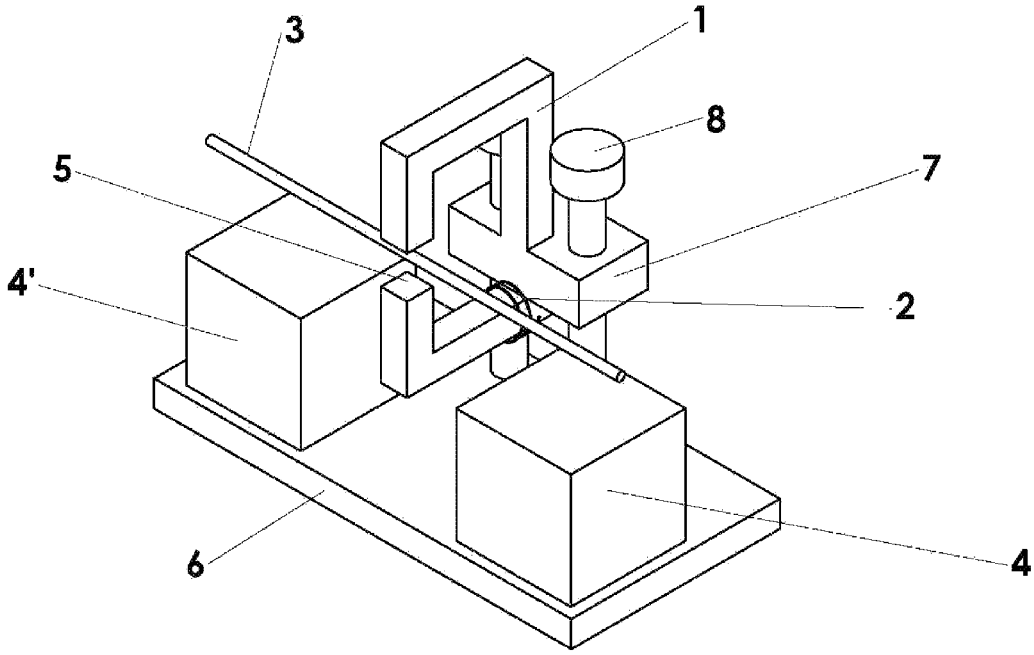
FIG. 3 is a perspective view of a pickup, in accordance with an embodiment of the invention.

FIGS. 1-3 show various views of a pickup, in accordance with various embodiments of the invention. In one embodiment, the pickup includes a magnetically susceptible transducer core 1, an electrically conductive coil 2, a magnetically susceptible string 3, permanent magnet 4, gap 5, base plate 6, a mounting plate 7, and a screw 8. The permanent magnet 4 is coupled to the base plate 6. The base plate 6 is coupled to the core 1 via the mounting plate 7. The height of the core 1 relative to the base plate 6 is adjustable using the screw 8. The core 1 includes the coil 2 having one or more turns disposed about its perimeter. The core 1 defines the gap 5 for receiving the string 3. The string 3 extends through the gap 5 and over the permanent magnet 4. In one particular embodiment, additional permanent magnets may be employed as illustrated.

Magnetic flux is driven on the magnetically susceptible string 3 by the permanent magnet 4. The magnetic flux in turn travels from the string 3 across the gap 5 and through the core 1. Thus, when the string 3 mechanically vibrates the magnetic flux within the core 1 also vibrates. The vibrating magnetic flux in the core 1 induces a current to flow in the coil 2 that is representative of the harmonic content from the mechanically vibrating string 3. This current can be amplified and reproduced electronically. The magnetic flux returns from the core 1 to the permanent magnet 4 via the magnetically susceptible base plate 6. Accordingly, the pickup is usable in association with at least one string on any stringed musical instrument.

In certain embodiments, the core 1 is differently shaped such as with only a single arm. In an alternate embodiment, the core 1 is differently angled relative to the string 3 or base 6. In yet a further embodiment, magnetic flux does not return from the core 1 to the magnet 4. In an additional embodiment, the mounting plate 7 is omitted. In further embodiments, a plurality of magnets 4 are employable. In yet another embodiment, a plurality of strings 3 can reside in the gap 5. In an alternate embodiment, any of the elements can be positioned relative to one another. In yet a further embodiment, the core 1 is rotatable to permit use with strings that vibrate in different planes.

Figure 4:
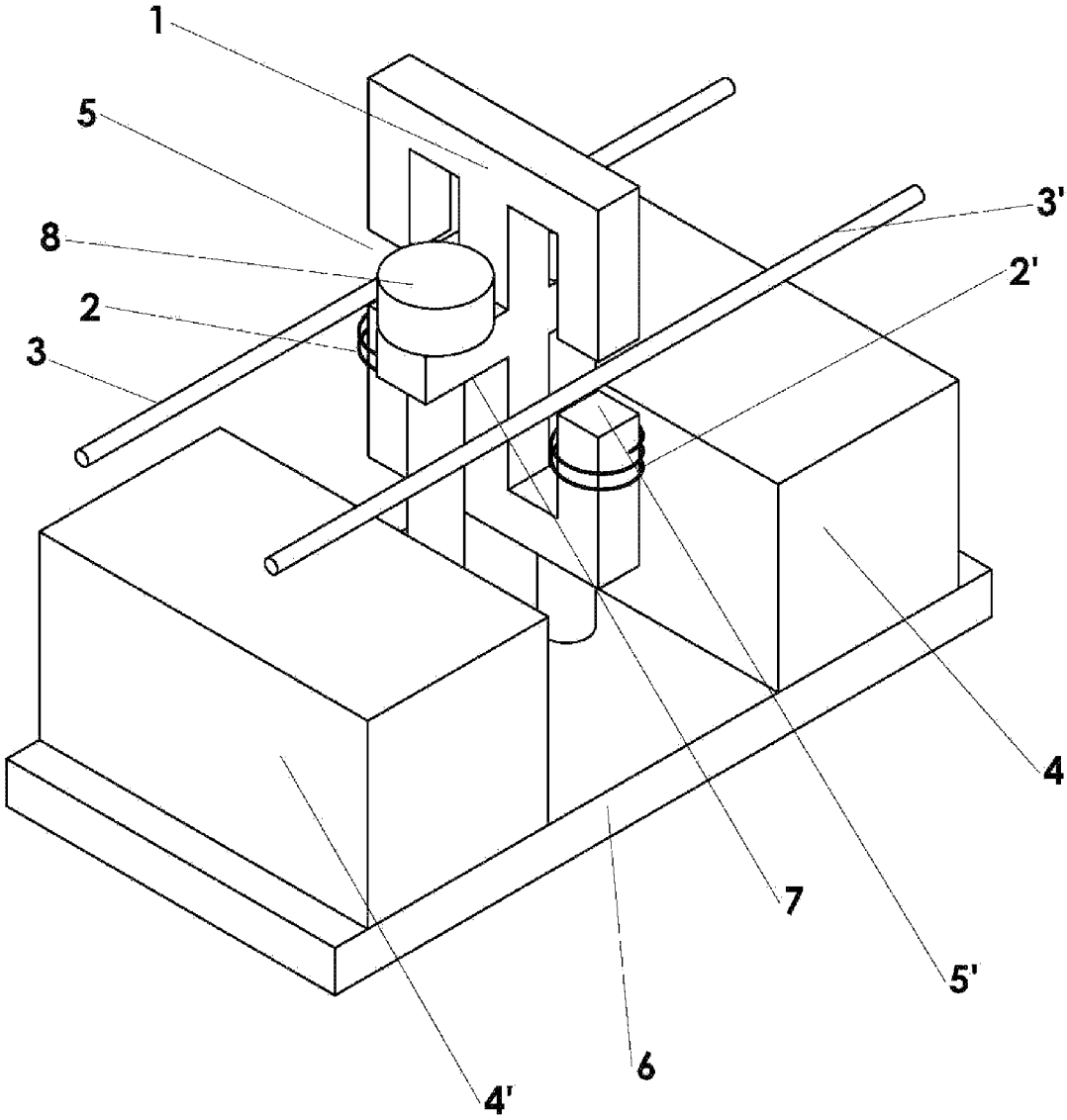
FIG. 4 is a perspective view of a pickup for a plurality of strings, in accordance with an embodiment of the invention.

FIG. 4 is a perspective view of a pickup for a plurality of strings, in accordance with an embodiment of the invention. In one embodiment, the pickup includes a magnetically susceptible transducer core 1, an electrically conductive coil 2, a magnetically susceptible string 3, a permanent magnet 4, a gap 5, a base plate 6, a mounting plate 7, and a screw 8 as described more fully in reference to FIGS. 1-3 supra. The pickup further includes a second coil 2', string 3', and gap 5'. The core 1 defines opposing gaps 5 and 5' for receiving adjacent strings 3 and 3'. The adjacent strings 3 and 3' run proximate to the permanent magnet 4 and through the gaps 5 and 5', respectively. Accordingly, magnetic flux is driven onto the strings 3 and 3' from the permanent magnet 4, which magnetic flux is then configurable to pass across the gaps 5 and 5', respectively, to induce current to flow in the coils 2 and 2'.

In an alternative embodiment, additional permanent magnets 4 are employable. In one particular embodiment, a plurality of strings 3 or 3' can reside in any of the gaps 5 and 5'. In an additional embodiment, only a single set of the coils 2 and 2' are used. In an alternate embodiment, additional coils 2 or 2' are employable. In yet a further embodiment, the core 1 is configurable to define additional or fewer of the gaps 5 and 5'. In another embodiment, the screw 8 or the mounting plate 7 are omitted. In a further embodiment, the core 1 is alternatively shaped or positioned relative to any of the strings 3 and 3' or the base plate 6. In yet a further particular embodiment, the coils 5 and 5' can combine to produce a single electrical signal or can produce separate electrical signals.

Figure 5:
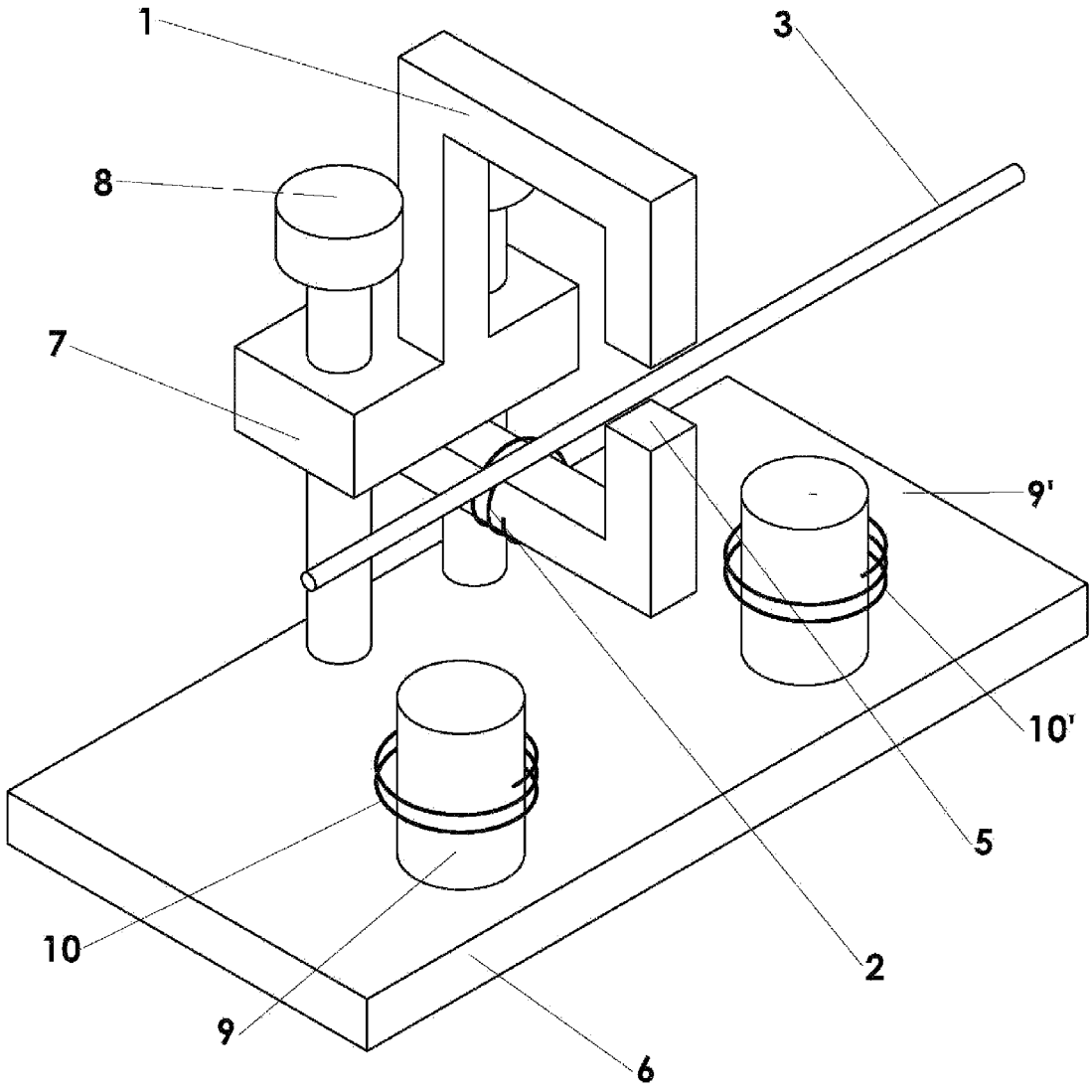
FIG. 5 is a perspective view of a pickup using electromagnets, in accordance with an embodiment of the invention.

FIG. 5 is a perspective view of a pickup using electromagnets, in accordance with an embodiment of the invention. In one embodiment, the pickup includes a magnetically susceptible transducer core 1, an electrically conductive coil 2, a magnetically susceptible string 3, a gap 5, a base plate 6, a mounting plate 7, and a screw 8 as described more fully in reference to FIGS. 1-4 supra. The pickup further includes one or more electromagnets comprised of a second core 9 about which a second coil 10 is disposed. Current driven through the second coil 10 is configurable to produce magnetic flux similar to a permanent magnet. In certain embodiments, the electromagnet can be supplemented with one or more permanent magnets or electromagnets.

Figure 6:
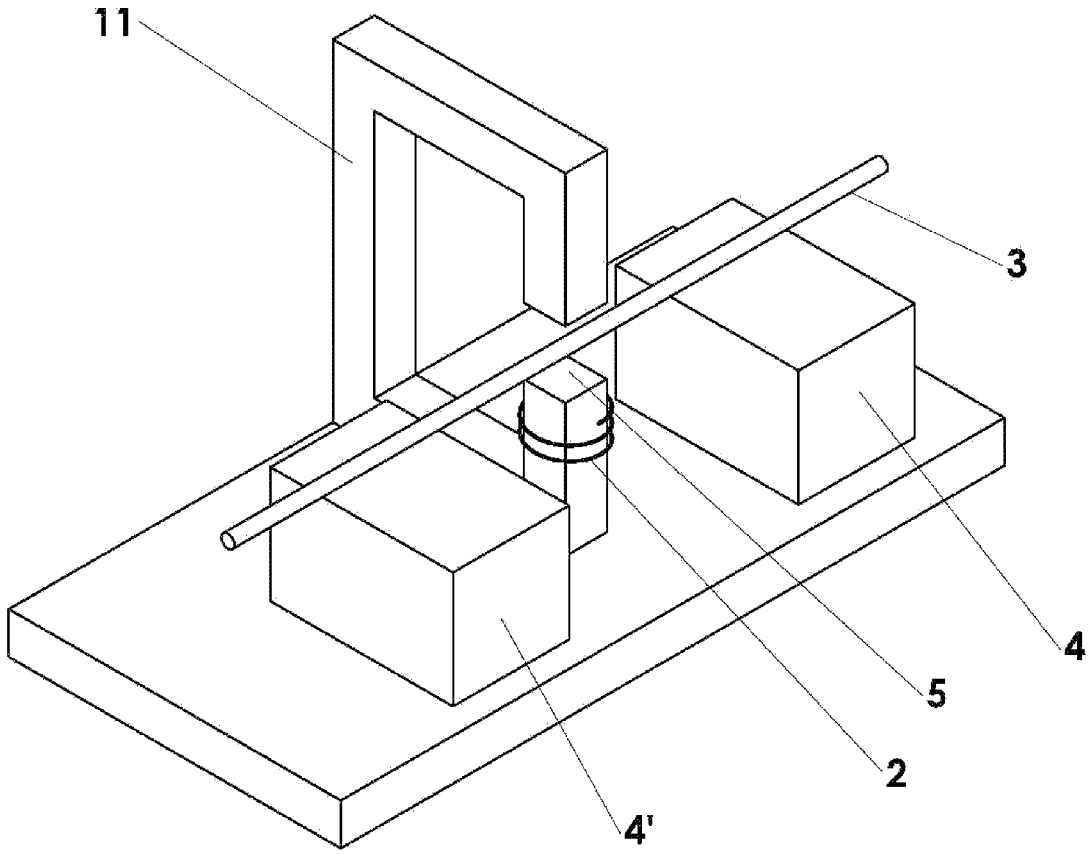
FIG. 6 is a perspective view of an alternative embodiment of a pickup for increasing magnetic efficiency, in accordance with an embodiment of the invention.

FIG. 6 is a perspective view of an alternative embodiment of a pickup for increasing magnetic efficiency, in accordance with an embodiment of the invention. In one embodiment, the pickup includes a magnetically susceptible transducer core 11, an electrically conductive coil 2, a magnetically susceptible string 3, and a gap, as described more fully in reference to FIGS. 1-5 supra. The core 11 includes the base plate 6 (FIG. 1) and the core 1 (FIG. 1) as a single component. Because the magnetic field is contained within substantially only the core 11 and the string 3, the permanent magnet 4 can be very weak. In additional embodiments, one or more permanent or electromagnets can supplement or replace the permanent magnet 4.

Figure 7:
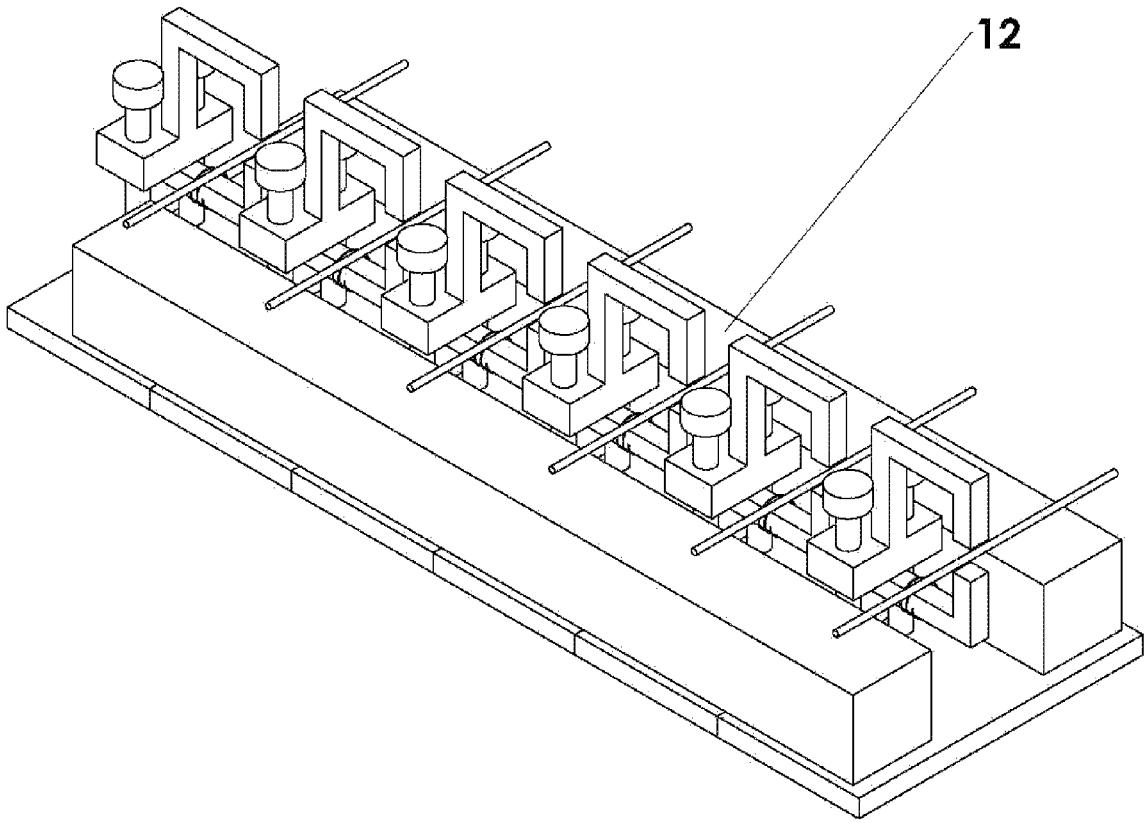
FIG. 7 is a perspective view of a plurality of pickups, in accordance with an embodiment of the invention.

FIG. 7 is a perspective view of a plurality of pickups, in accordance with an embodiment of the invention. In one embodiment, the plurality of pickups is comprised of one or more of the pickups described in reference to FIGS. 1-6. In one particular embodiment, a one or more of the permanent magnets 4 or electromagnets are used to drive magnetic flux to each of the plurality of pickups. In yet another particular embodiment, any of the pickups or plurality of pickups described herein can be encased in protective material.

While preferred and alternate embodiments of the invention have been illustrated and described, as noted above, many changes can be made without departing from the spirit and scope of the invention. Accordingly, the scope of the invention is not limited by the disclosure of these preferred and alternate embodiments. Instead, the invention should be determined entirely by reference to the claims that follow.

What is claimed is:

1. An electromagnetic transducer device, the device comprising:

a core, the core being magnetically susceptible, the core being an elongated member having opposing ends that are linearly aligned in close proximity to define a substantially closed loop interrupted by a gap for passing a string, the core configurable to surround the string on at least three sides;

a magnet, the magnet being proximate to the string and configurable to transfer magnetic flux to the string, the string being magnetically susceptible, and the string being configurable to transfer magnetic flux across the gap to each of the opposing ends of the core with at least a portion of magnetic flux lines from the string being substantially aligned along the linear path defined by the opposing ends of the core; and an electrically conductive coil, the coil being disposed about the core, the coil being configurable to produce current in response to the magnetic flux from the core, wherein mechanical vibration of the string produces a vibration of the magnetic flux in the core and wherein vibration of the magnetic flux in the core induces current in the coil.

2. The device of claim 1, further comprising:

a base, the magnet and the core being coupled to the base, the base being configurable to mounting on a musical instrument having the string.

3. The device of claim 2 wherein the base is magnetically susceptible and magnetic flux from the core is configurable to return to the magnet via the base.

4. The device of claim 2, further comprising:

a mounting plate, the mounting plate adjustably coupling the core to the base, wherein adjustment of the mounting plate adjusts a height of the core relative to the base.

5. The device of claim 2, further comprising:

a height adjusting device, the height adjusting device being magnetically susceptible, the height adjusting device adjustably coupling the magnet to the base, wherein adjustment of the height adjusting device adjusts a distance between the magnet and the string.

6. The device of 2 wherein the core is rotatably adjustable relative to the string to facilitate a plurality of string vibration planes.

7. The device of claim 2, further comprising:

a second magnet, the second magnet being oppositely disposed from the magnet relative to the core, the second magnet being proximate to the string and configurable to transfer magnetic flux to the string, wherein the string extends across the magnet, through the gap, and across the second magnet and wherein magnetic flux from the core is configurable to return to the magnet and the second magnet via the base.

8. The device of claim 1 wherein the magnet is disposed adjacent to the core and wherein the string extends across the magnet and through the gap.

9. The device of claim 1 wherein the core extends at least partially over the string.

10. The device of claim 1 wherein the magnet is configurable to transfer magnetic flux to the string independently from the core.

11. A musical instrument having an electromagnetic transducer device, the musical instrument comprising:

a string, the string being magnetically susceptible, the string coupled to the musical instrument;

a core, the core being magnetically susceptible, the core being an elongated member having opposing ends that are linearly aligned in close proximity to define a substantially closed loop interrupted by a gap for passing a string, the core configurable to surround the string on at least three sides;

a magnet, the magnet being proximate to the string and configurable to transfer magnetic flux to the string, the string being configurable to transfer magnetic flux across the gap to each of the opposing ends of the core with at least a portion of magnetic flux lines from the string being substantially aligned along the linear path defined by the opposing ends of the core; and an electrically conductive coil, the coil being disposed about the core, the coil being configurable to produce current in response to the magnetic flux from the core, wherein the magnet and the core are coupled to the musical instrument, wherein mechanical vibration of the string produces a vibration of the magnetic flux in the core, and wherein vibration of the magnetic flux in the core induces current in the coil.

12. The musical instrument of claim 11, further comprising:

a mounting plate, the mounting plate adjustably coupling the core relative to the musical instrument, wherein adjustment of the mounting plate adjusts a height of the core relative to the musical instrument.

13. The musical instrument-of claim 11, further comprising:

a height adjusting device, the height adjusting device adjustably coupling the magnet relative to the musical instrument, wherein adjustment of the height adjusting device adjusts a distance between the magnet and the string.

14. The musical instrument of claim 11 wherein the core is rotatably adjustable relative to the string to facilitate a plurality of string vibration planes.

15. The musical instrument of claim 11, further comprising:

a second magnet, the second magnet being oppositely disposed from the magnet relative to the core, the second magnet being proximate to the string and configurable to transfer magnetic flux to the string, wherein the string extends across the magnet, through the gap, and across the second magnet.

16. The musical instrument of claim 11 wherein the core extends at least partially over the string.

17. The musical instrument of claim 11 wherein the magnet is configurable to transfer magnetic flux to the string independently from the core.

18. An electromagnetic transducer device, the device comprising:

a core, the core being magnetically susceptible, the core being an elongated member having opposing ends that are linearly aligned in close proximity to define a substantially closed loop interrupted by a gap for passing a string, the core configurable to surround the string from below, above, and on at least one side relative to an instrument;

a magnet, the magnet being proximate to the string and configurable to transfer magnetic flux to the string, the string being magnetically susceptible, and the string being configurable to transfer magnetic flux across the gap to each of the opposing ends of the core with at least a portion of magnetic flux lines from the string being substantially aligned along the linear path defined by the opposing ends of the core; and an electrically conductive coil, the coil being disposed about the core, the coil being configurable to produce current in response to the magnetic flux from the core, wherein mechanical vibration of the string produces a vibration of the magnetic flux in the core and wherein vibration of the magnetic flux in the core induces current in the coil.

* * * * *